United States Patent [19]

Lawson et al.

[11] 4,152,151

[45] May 1, 1979

[54] PRESSURE INDUCED DEVELOPMENT OF ELECTROSTATIC LATENT IMAGES

[75] Inventors: Terence M. Lawson, Aldgate; Blair D. Howell, Lockleys, both of Australia

[73] Assignee: Research Laboratories of Australia Pty. Limited, Eastwood, Australia

[21] Appl. No.: 585,056

[22] Filed: Jun. 9, 1975

[30] Foreign Application Priority Data

Jun. 7, 1974 [AU] Australia ..... PB7801
Aug. 23, 1974 [AU] Australia ..... PB8637

[51] Int. Cl.[2] ..... G03G 13/10

[52] U.S. Cl. ..... 96/1 LY; 96/1.4; 427/17; 427/24

[58] Field of Search ..... 427/15, 17, 24; 96/1 LY, 1.4; 355/10; 118/DIG. 23, 661

[56] References Cited

U.S. PATENT DOCUMENTS

| | | | |
|---|---|---|---|
| 3,556,784 | 1/1971 | Robinson et al. | 96/1.4 |
| 3,595,772 | 7/1971 | Zucker | 96/1.4 X |
| 3,806,355 | 4/1974 | Kaufman | 427/17 |
| 3,949,116 | 4/1976 | Lawson et al. | 427/17 |
| 4,115,114 | 9/1978 | Quang et al. | 427/17 |

*Primary Examiner*—Michael F. Esposito
*Assistant Examiner*—Stuart D. Frenkel
*Attorney, Agent, or Firm*—Fitzpatrick, Cella, Harper & Scinto

[57] ABSTRACT

A method for pressure induced development of electrostatic latent images comprising forming an electrostatic latent image on a support member and subsequently placing the image bearing surface of the member in face contact with a receiving sheet, applying a dispersion to at least one of the contacting surfaces in a first state wherein the flow properties of the dispersion are non-Newtonian and the dispersion consists of a liquid phase and of a solid phase comprising flocculated electroscopic marking particles forming a matrix sufficiently strong to prevent extraction of individual electroscopic marking particles from the matrix by electrostatic attraction, using a pressure roller to apply to the dispersion a shear stress of sufficient magnitude to convert the dispersion to a second state wherein the flow properties of the dispersion become Newtonian and the solid phase is deflocculated in the liquid phase to allow individual electroscopic marking particles to deposit in accordance with the latent image, and separating the support member and the sheet whereby an image deposit is produced on the member and the sheet.

17 Claims, 5 Drawing Figures

PRESSURE INDUCED DEVELOPMENT OF ELECTROSTATIC LATENT IMAGES

BACKGROUND OF THE INVENTION

In electrostatic printing it is generally required to render visible or develop a latent image defined by electrostatic charges contained on a dielectric or insulative surface of a recording member. Such recording member may be a photoconductor as used in the commonly known process of electrophotography or xerography, or a dielectric material as used in facsimile recording or computer printout and the like. The term electrostatic printing also applies to other methods of latent electrostatic image formation and rendering visible same, such as for instance to those methods in which a latent electrostatic image is formed on a surface by the so-called Dember effect, or by thermal means, or by physical means such as pressure or impact and the like.

The electrostatic latent images thus formed are rendered visible or developed in accordance with prior art practices by the application to the surface of electroscopic marking particles which are more or less selectively attracted to or repelled by the electrostatic charges defining the latent image, depending on whether a direct or a reversal reproduction is desired. In the case of direct reproduction the electroscopic marking particles are deposited in the latent image areas, whereas in the case of reversal re-production the particles are deposited outside the latent image areas.

Such prior art methods of development fall into two distinct categories, namely the so-called dry development method and the so-called liquid development method. Both these methods are widely known.

Dry development involves the attraction of electroscopic marking particles or so-called dry toners to the surface bearing the electrostatic latent image, such electroscopic marking particles being applied in the form of a powder cloud or carried on a triboelectrically different carrier particle.

In liquid development the surface containing the electrostatic latent image is contacted with a so-called liquid toner which comprises a dispersion of electroscopic marking particles in an insulating carrier liquid having a volume resistivity is excess of $10^9$ ohm-cm and a dielectric constant less than 3.0. The electroscopic marking particles or toner particles are attracted from said carrier liquid to the electrostatic latent image and deposited on the surface containing said image. The electroscopic marking particles usually are comprised of pigment as coloring matter and resins or varnishes or oils which serve as dispersing aids, fixing agents and can also confer the desired polarity and charge or sensitivity onto said particles.

In both dry and liquid methods of development the image formed on the surface of the recording member can be fixed thereon or transferred onto another surface if so desired.

A more recent type of electrostatic toner has now been developed which departs from each of the previously mentioned toning methods. This more recent toner consists of a solid and liquid phase in combination which is so formulated that the solid phase at rest is in a heavily bonded form in which the developer material or toner particles are joined by bonds forming a matrix or bonded flocculent structure, whereby the flow properties of the composition become non-Newtonian and whereby the developing material when applied to a surface containing a latent electrostatic image to be developed is restrained from migration to the surface to be developed and deposition thereon due to attraction by forces associated with the electrostatic latent image contained on said surface until sufficient shear exists to free the toner particles for development.

Such toners are essentially dispersions of a solid particulate phase in a liquid phase. The particulate solid phase and the liquid phase are so selected that the particulate matter is dispersed in a strongly flocculated state, hereinafter called the first state. In this first state the flocculated particulate matter forms a matrix, that is to say the particles are substantially linked on bonded to each other and the liquid phase is contained substantially within such matrix and surrounding same. In this first state the toner dispersion possesses non-Newtonian pseudo-plastic or plastic or thixotropic flow properties, that is to say the dispersion requires a certain applied shear force before Newtonian flow occurs, in which state the solid particulate phase is deflocculated, this state being called henceforth the second state.

When the above described toner is applied in said first state to a surface containing an electrostatic latent image by for instance pouring over the surface or by means of an applicator roller without any pressure, that is to say when there is no shear stress applied to the toner except some stress due to gravity, we have found that such toner cannot be used or considered as a toner in the sense of the prior art definition in that the electrostatic latent image contained on said surface is not developed at all, or if so, only to relatively low density, whilst the whole surface including the background area becomes heavily coated by the toner adhering to the surface and drying rapidly thereon.

If, however when applying the toner in said first state to a surface containing an electrostatic latent image, a shear stress of appropriate magnitude is applied simultaneously with or subsequently to the toner, for instance by means of roller pressure, and the toner is moved over said surface whilst under the influence of said shear stress, we have found that the electrostatic latent images contained on said surface are developed to high density, whilst the background areas remain free of toner deposit and furthermore the liquid phase wets the surface only superficially and consequently in cases where, for instance, the surface is contained on an absorbent substrate such as paper, liquid penetration into same and liquid carry-out are only slight.

Such toners provide a method of developing electrostatic latent images contained on a surface, such as for instance the surface of an electrophotographic or electrostatic recording member, in which method a toner dispersion is used which comprises a liquid phase and a dispersed solid phase consisting of electroscopic marking particles in a first state in which the flow properties of the toner are non-Newtonian and the electroscopic marking particles comprising the solid phase are flocculated forming a matrix which is structurally strong enough to prevent the extraction from it of individual electroscopic marking particles, which in this state are parts of the matrix, by attraction to the electroscopic latent image. If now a shear stress is applied to the toner, for instance by means of roller pressure, the toner is converted from the first state to a second state in which the flow properties of the toner become Newtonian and the solid phase becomes deflocculated. When this occurs the matrix is broken up into individual electroscopic marking particles which now form the dispersed phase, and in this state the electroscopic marking particles can be attracted by the electroscopic latent image and deposited onto the surface to give highly effective development of the image.

It has been found that this last mentioned toner type possesses many advantages over the earlier prior art types previously described in relation to electrostatic latent image development characteristics. Thus using this type of toner composition, hereinafter referred to as plastic flow toners, image development is very fast, solid fill-in is readily achievable, and continuous tone development is readily achievable. Because of the structure of plastic flow toners, background staining of developed surfaces is negligible, and solvent carry-out by the developed surface is minimal. However the low solvent carry-out which is a feature of plastic flow toners impairs their use in processes in which the developed image deposit is required to be transferred to another surface after development.

The present invention teaches a method whereby plastic flow toners may be used to develop images on plain paper surfaces and the like under the control of an electrostatic latent image.

SUMMARY OF THE INVENTION

It is an object of the present invention to provide a method of and means for forming a developed image on an unsensitised paper surface or the like using plastic flow toners.

Another object of the present invention is to provide a method of and means for using an electrostatic latent image on a control member to control the formation of a developed image on an unsensitised paper surface.

Yet another object of this invention is to provide a method of and means for forming a developed image on a plain paper surface wherein liquid carry-out by the plain paper sheet is reduced virtually to boundary layer thickness.

A further object of this invention is to provide a method of and means for developing images on plain paper sheets whereby environmental pollution by hydrocarbon vapours is substantially reduced over prior art methods. A still further object of this invention is to provide a method of and means for developing images on plain paper sheets whereby liquid wastage is substantially reduced over prior art methods.

Other advantages of the method of the present invention will become apparent from the following description.

Office copying methods are known in which an image is formed on a photoconductor surface using various charging and exposing techniques, following which the image is developed or toned by the attraction thereto of dry or liquid dispersed electroscopic marking particles or toners. The developed image deposit is subsequently transferred to a receptor surface, such as a plain paper web or the like and fixed thereto. Such office copying methods are described for example in U.S. Pat. No. 3,438,706 of Tanaka et al. and U.S. Pat. No. 3,711,796 of Saito et al.

As previously described, plastic flow toners of the type referred to are not readily adapted to transfer copier application as the quantity of liquid contained within the image deposit is generally insufficient to provide toner mobility required for electrostatic transfer purposes, particularly as these toners tend to be in a highly bonded form in the absence of applied shear.

We have now found that such plastic flow toners can be used for the production of developed copy on substantially plain paper sheets in such transfer copying processes provided the plastic flow toner is applied in such a manner that a body of such toner is present at the area of contact between the latent image bearing surface and the copy sheet. Thus the toner in the rest condition may be applied to the latent image bearing surface and subsequently contacted with the copy sheet bearing surface under sufficient pressure to provide the necessary shear force. This causes development of the image on the latent image bearing surface and simultaneously produces an image in the reverse sense on the copy sheet. Alternatively a pool of plastic flow toner may be formed at the areas of contact between the latent image bearing surface and the copy sheet by injection therein of a metered quantity of such toner.

By choice of toner polarity characteristics the copy produced on the transfer sheet may be a positive or negative copy of the original, as desired. Thus if the latent image on the image bearing surface is of positive polarity and the toner is also of positive polarity the image developed on the latent image bearing surface will be a reversal of the original and consequently the developed image on the transfer sheet will be a facsimile of the original. Under the same conditions the use of a toner of negative polarity will produce on the transfer sheet a copy which is a reverse of the original.

BRIEF DESCRIPTION OF THE DRAWINGS

In order that the invention may be more readily understood, reference will now be made to the drawings, in which.

DETAILED DESCRIPTION OF THE INVENTION

Figure 1:
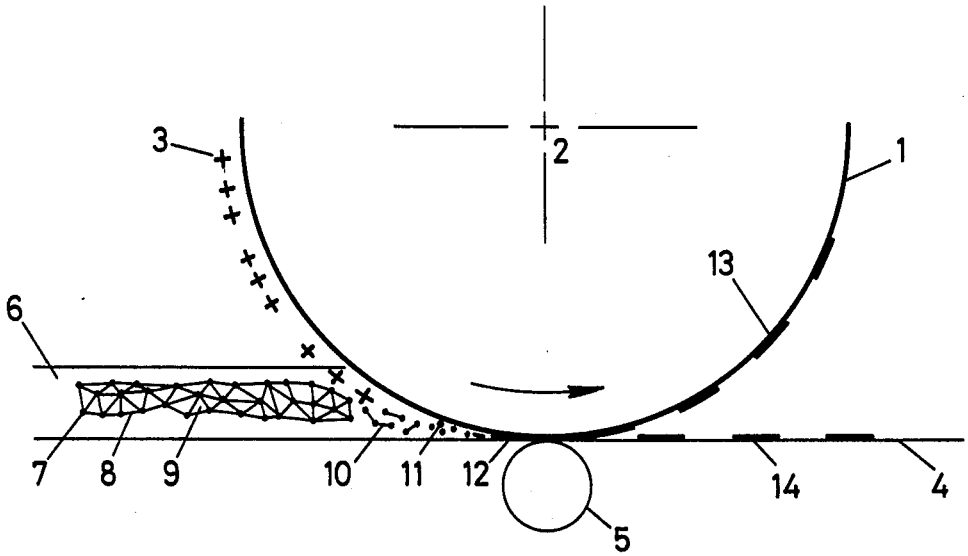
FIG. 1 illustrates the use of this present invention in those instances in which the plastic flow toner is applied to the transfer sheet to produce copy on the transfer sheet which is a facsimile of the original, hereinafter referred to as embodiment 1.

Referring now to FIG. 1 in detail, a latent image bearing member 1 is illustrated in the form of a drum rotating in the direction shown around axis 2. The electrostatic latent image on latent image bearing member 1 is represented by areas of positive charge 3. A transfer sheet 4 is positioned to contact the latent image bearing member 1 under controlled pressure applied by pressure roller 5. Transfer sheet 4 has, on its surface, a layer of plastic flow toner 6, consisting of positively charged toner aggregates 7 in a strongly flocculated state forming a matrix as shown by symbolically represented interparticulate bonds or bonding forces 8 and of a liquid phase 9 which as will be seen is contained within and surrounding said toner aggregate solid phase 7. In this area the strongly flocculated toner aggregates 7 may be considered to be in a first state, at which image development does not occur because the aggregate particle size and interparticulate bonds or bonding forces are sufficient to prevent toner deposition. As shear is progressively applied the interparticulate bonds or bonding forces begin to break down as shown at 10. Further increase in the applied shear continues the bond break down until relatively free toner aggregates are produced as shown at 11, followed by the final break down of the toner aggregates 11 into substantially individual toner particles 12, at which time image development occurs. The toner is thus at this point in an active state, referred to as a second state, at which the electrostatic field of the latent image can cause particle migration. As the toner particles are of positive polarity, deposition on the latent image bearing member 1 occurs in those areas not carrying a positive charge to form developed image deposit 13 on latent image bearing member 1 in the opposite sense to electrostatic latent image 3. Consequently image deposit 14 which remains on transfer sheet 4 is a facsimile of the information represented by latent image 3 and is thus a facsimile of the original.

Figure 2:
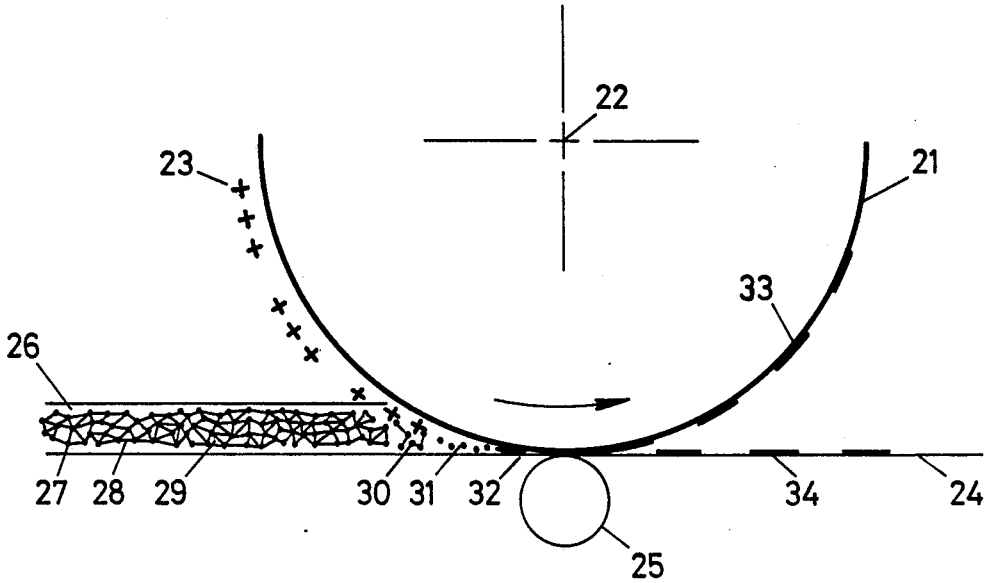
FIG. 2 illustrates the use of the configuration of embodiment 1 to produce copy on the transfer sheet which is a reverse of the original.

Referring now to FIG. 2, a latent image bearing member 21 is illustrated in the form of a drum rotating in the direction shown, around axis 22. The electrostatic latent image on latent image bearing member 21 is represented by areas of positive charge 23. A transfer sheet 24 is positioned to contact the latent image bearing member 21 under controlled pressure applied by pressure roller 25. Transfer sheet 24 has on its surface a layer of plastic flow toner 26, consisting of negatively charged toner aggregate 27 in a strongly flocculated state forming a matrix as shown by symbolically represented bonds or bonding forces 28 and of a liquid phase 29 which as will be seen is contained within and surrounding said toner aggregate solid phase 27. In this area the strongly flocculated toner aggregates 27 may be considered to be in a first state at which image development does not occur because the aggregate particle size and interparticulate bonds or bonding forces are sufficient to prevent toner deposition. As shear is progressively applied the interparticulate bonds or bonding forces begin to break down as shown at 30. Further increase in the applied shear continues the bond breakdown until relatively free toner aggregates are produced as shown at 31, followed by the final break-down of toner aggregates 31 into substantially individual toner particles 32 at which time image development occurs. The toner is thus at this point in an active state, referred to as a second state, at which the electrostatic field of the latent image can cause particle migration. As the toner particles are of negative polarity, deposition on the latent image bearing member 21 occurs in those areas carrying a positive electrostatic charge, consequently image deposit 33 formed on latent image bearing member 21 is a facsimile of the original and image deposit 34 formed on transfer sheet 24 is a reverse reproduction of the original.

Figure 3:
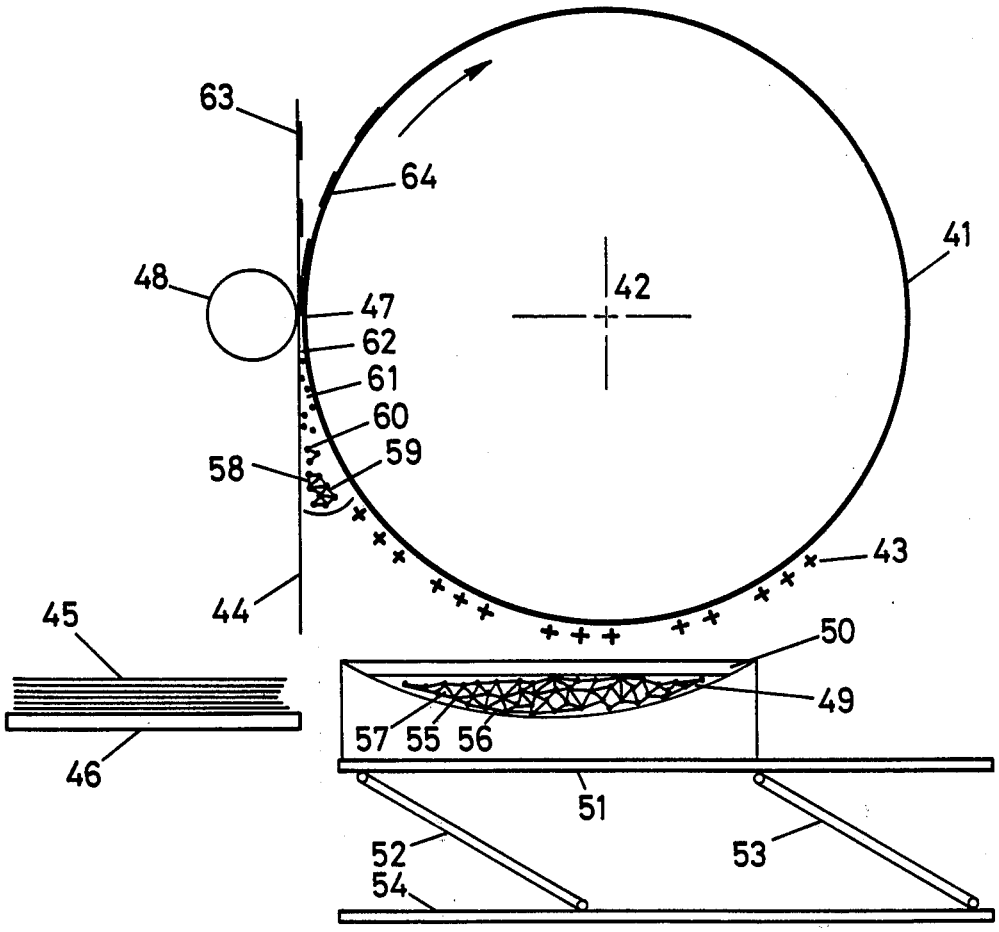
FIG. 3 illustrates the use of this present invention in those instances in which the plastic flow toner is applied to the latent image bearing member, hereinafter referred to as embodiment 2.

Referring now to FIG. 3 in detail, which illustrates the second embodiment of this invention, a latent image bearing member 41 is illustrated in the form of a drum rotating in the direction shown around axis 42. The electrostatic latent image on latent image bearing member 41 is represented by areas of positive charge 43. A copy sheet 44, from stack of copy sheets 45 on support member 46, is transported by means not shown to contact latent image bearing member 41 at line contact or nip area 47 under controlled pressure applied by pressure roller 48. Plastic flow toner 49 is contained in its strongly flocculated form in bath 50, carried on support member 51, which support member 51 is connected by pin-jointed arms 52 and 53 to base member 54. Pin-jointed arms 52 and 53 allow bath 50 to be raised by means not shown to allow plastic flow toner 49 contained in bath 50 to contact latent image bearing member 41 at pre-selected positions. Plastic flow toner 49 consists of charged toner aggregates 55 in a strongly flocculated state forming a matrix as shown by symbolically represented bonds or bonding forces 56 and a liquid phase 57 which, as will be seen, is contained within and surrounding said aggregate toner solid phase 55. The strongly flocculated toner aggregates 55 contained in said bath 50 may be considered to be in a first state, at which image development can not occur because the aggregate particle size and interparticulate bonds or bonding forces are sufficient to prevent toner deposition.

In operation of the invention in accordance with this second embodiment, pin-jointed arms 52 and 53 are actuated to raise bath 50 to cause plastic flow toner 49 to contact the surface of latent image bearing member 41 for a pre-selected time. The area on the surface of latent image bearing member 41 which is contacted by plastic flow toner 49 in its first state is preferably but not necessarily that area immediately preceding the area containing the electrostatic latent image. This area acts as a transport member to carry plastic flow toner 49 in its first state towards contact area 47, forming pool of toner 58 contacting latent image bearing member 41 and copy sheet 44 in that area immediately preceding contact area 47. Toner pool 58 is shown symbolically to comprise four zones, 59,60,61 and 62. In zone 59 toner is illustrated in its first state, or strongly flocculated aggregate state. Zone 60 represents the first stage of breakdown of interparticulate bonding forces as progressive shear is applied. Zone 61 represents the second stage of breakdown of interparticulate bonding forces in which toner particle agglomeration is still present, whereas Zone 62 represents the area in which the toner aggregates are broken down into substantially individual toner particles at the area of maximum shear, at which time development occurs. The toner is thus at this point in an active state, referred to as the second state, in which the electrostatic field of the latent image can cause particle migration. In those instances where the toner particles are of a positive polarity they are repelled by the positively charged electrostatic latent image 43 and deposited on copy sheet 44 to form developed image deposit 63 thereon which is a facsimile of the positively charges electrostatic latent image 43. The residual developed image deposit 64 on the surface of the latent image bearing member 41 is reverse sense to the electrostatic latent image 43. In those instances where the toner particles are of negative polarity the developed image deposit 64 on the surface of latent image bearing member 41 is a facsimile of the electrostatic latent image 43, whereas image deposit 63 on copy sheet 44 is a reproduction in the reverse sense of electrostatic latent image 43.

Figure 4:
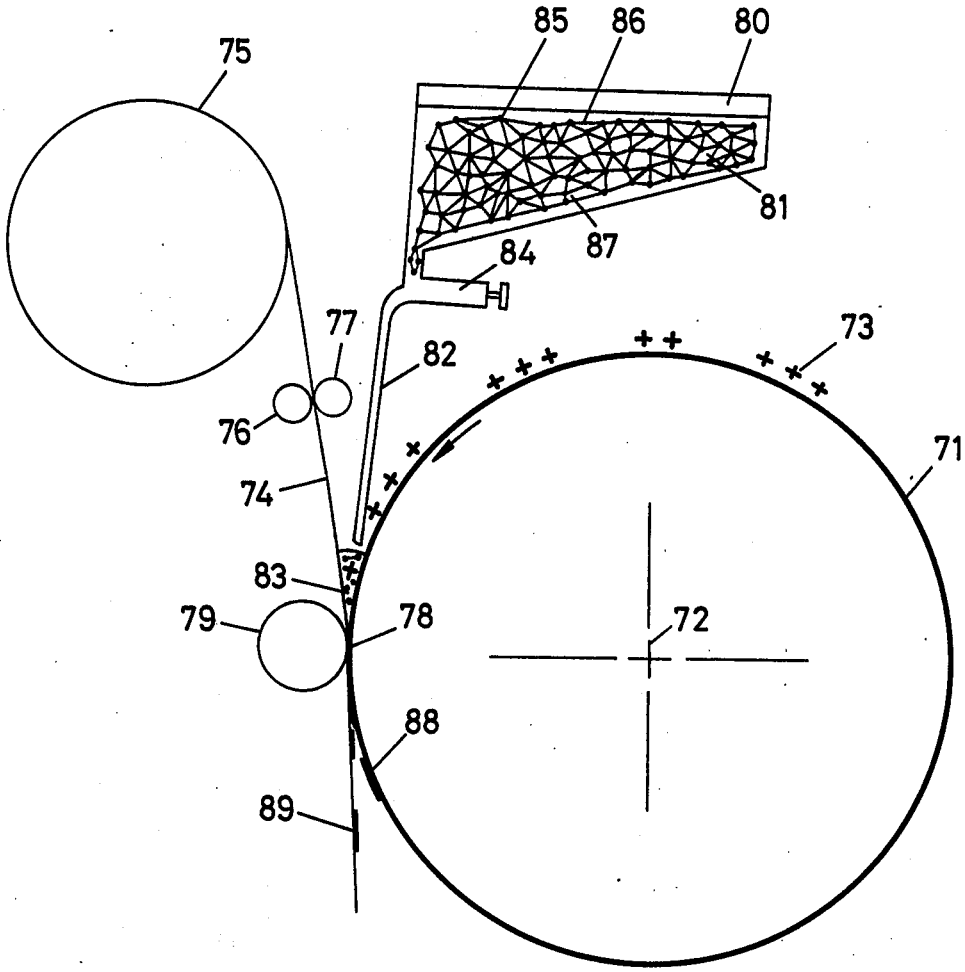
FIG. 4 illustrates the use of this invention in those instances in which the plastic flow toner is injected into the upstream side of the nip area or contact area between the latent image bearing surface and the copy sheet, hereinafter referred to as embodiment 3.

Referring now to FIG. 4, which illustrates the third embodiment of this invention, latent image bearing member 71 is illustrated in the form of a drum rotating in the direction shown around axis 72. The electrostatic latent image on latent image bearing member 71 is represented by areas of positive charge 73. Copy sheet 74, quillotined at the required length from copy sheet feed reel 75, is directed by guide rollers 76 and 77 to contact latent image bearing member 71 at contact area 78 under controlled pressure applied by pressure roller 79. Toner tank 80, containing plastic flow toner 81 in its first state, is positioned above contact area 78, whereby a controlled quantity of plastic flow toner 81 flows through pipe 82 to form toner pool 83 above contact area 78. Metering valve or pump 84 controls the quantity of plastic flow toner 81 forming pool 83. Plastic flow toner 81 consists of charged toner particle aggregates 85 in a strongly flocculated state forming a matrix as shown by symbolically represented bonds or bonding forces 86 and a liquid phase 87 which as will be seen is contained with and surrounding said charged toner aggregate solid phase 85. The strongly flocculated toner particle aggregates 85 may be considered to be in the first state as previously described. In operation of the invention in accordance with this third embodiment, the strongly flocculated toner 85 contained within pool 83 breaks down structurally under progressive shear as previously described in relation to the first embodiment to allow image development to occur at contact area 78, thus forming developed image deposit 88 on the surface of said latent image bearing member 71 and image deposit 89 on the surface of said copy sheet 74. It will be realised that image deposit 89 on copy sheet 74 will be a facsimile or reverse reproduction of electrostatic latent image 73 depending on the polarity of toner solid phase 85 as previously described in relation to the second embodiment of this invention.

It will be apparent that tone tank 80 need not necessarily be mounted above contact area 78, and that in some instances it may be advantageous to position toner tank 80 lower than contact area 78 to allow gravitational return of excess toner 81 from toner pool 83 to toner tank 80.

Figure 5:
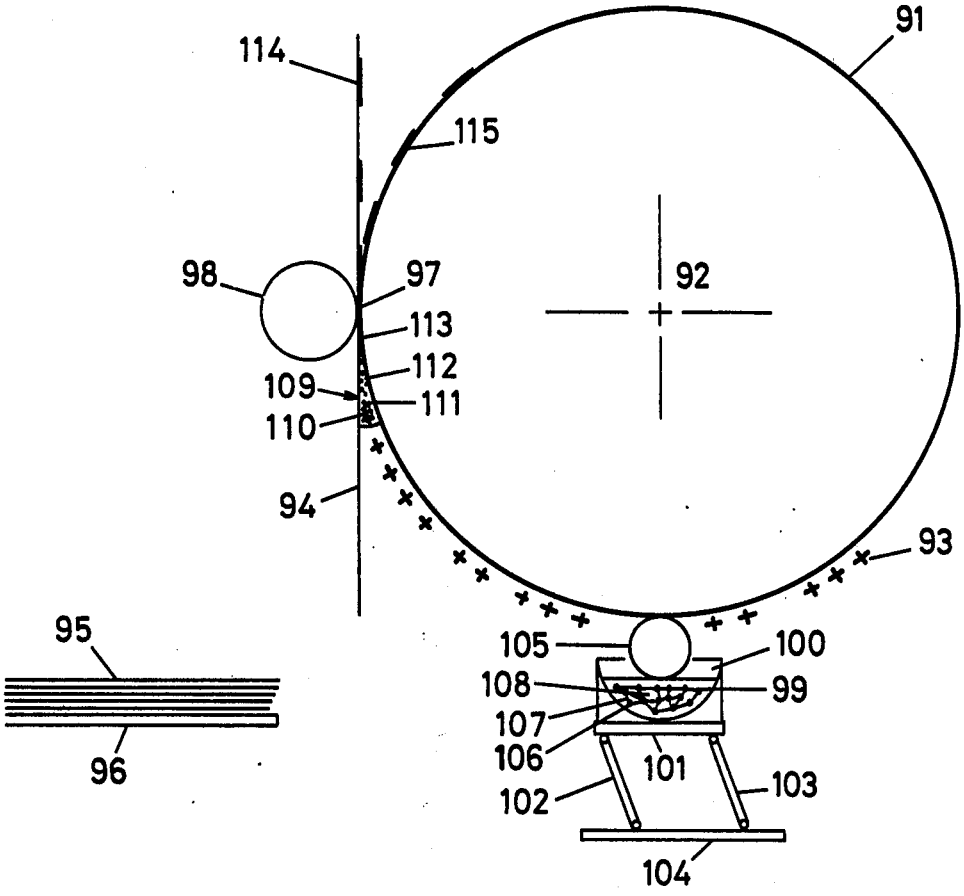
FIG. 5 represents an alternative arrangement in relation to embodiment 2 in which a metering roller is used to apply the plastic flow toner to the latent image bearing member.

Referring now to FIG. 5, a latent image bearing member 91 is illustrated in the form of a drum rotating in the direction shown around axis 92. The electrostatic latent image on latent image bearing member 91 is represented by areas of positive charge 93. A copy sheet 94, from stack of copy sheets 95 on support member 96, is transported by means not shown to contact latent image bearing member 91 at line contact or nip area 97 under controlled pressure applied by pressure roller 98. Plastic flow toner 99 is contained in its strongly flocculated form in bath 100, carried on support member 101, which support member 101 is connected by pin-jointed arms 102 and 103 to base member 104. Pin-jointed arms 102 and 103 allow bath 100 to be raised by means not shown to allow plastic flow toner 99 to contact applicator roller 105. Applicator roller 105 may also be raised by means not shown to contact latent image bearing member 91 at pre-selected positions with the layer of plastic flow toner 99 on applicator roller 105. The purpose of applicator roller 105 is to apply a pre-determined quantity of plastic flow toner 99 in its first state on the surface of latent image bearing member 91, and thus applicator roller 105 is not used as a pressure roller.

Plastic flow toner 99 consists of charged toner particle aggregates 106 in a strongly flocculated state forming a matrix as shown by symbolically represented bonds or bonding forces 107 and a liquid phase 108 which as will be seen is contained within and surrounding said aggregate toner solid phase 106.

In operation of the invention in accordance with this variant of the first embodiment, pin-jointed arms 102 and 103 are actuated to raise bath 100 and applicator roller 105 to cause plastic flow toner 99 to contact the surface of latent image bearing member 91 for a pre-selected time. As already described in relation to FIG. 3, this contact area is preferably but not necessarily that area immediately preceding the area containing the electrostatic latent image. This area acts as a transport member to carry plastic flow toner 99 in its first state towards contact area 97, forming pool of toner 109 contacting latent image bearing member 91 and copy sheet 94 in the area immediately preceding contact area 97. Toner pool 109 is shown symbolically to comprise four zones 110,111,112 and 113. In zone 110 toner is illustrated in its first state, or strongly flocculated aggregates state. Zone 111 represents the first stage of breakdown of interparticulate bonding forces as progressive shear is applied. Zone 112 represents the second stage of breakdown of interparticulate bonding forces in which toner particle agglomeration is still present, whereas Zone 113 represents the area in which the toner aggregates are broken down into substantially individual toner particles at the area of maximum shear, at which time development occurs. The toner is thus at this point in an active state, referred to as the second state in which the electrostatic field of the latent image can cause particle migration. In those instances where the toner particles are of a positive polarity they are repelled by the positively charged electrostatic latent image 93 and deposited on copy sheet 94 to form developed image deposit 114 thereon which is a facsimile of the positively charged electrostatic latent image 93. The residual developed image deposit 115 on the surface of the latent image bearing member 91 is in the reverse sense to the electrostatic latent image 93. In those instances in which the toner particles are of negative polarity developed image deposit 115 on the surface of latent image bearing member 91 is a facsimile of the electrostatic latent image 93, whereas image deposit 114 on copy sheet 94 is a reproduction in the reverse sense of electrostatic latent image 93.

It will also be apparent that copy sheets may be used in the third embodiment if desired and a continuous web of copy paper may be used in conjunction with the second embodiment. Further the latent image bearing member and pressure roller of each embodiment are ideally arranged for the application of electrical bias in the attraction or repulsion sense if desired.

It will be realised that the rate of carrier liquid absorbency into the paper of the copy sheet will have some influence on the performance of the plastic flow toner, as it is necessary for some liquid dispersant to be present in the toner composition at the time of image development. Consequently the copy paper used should have reasonable solvent hold-out characteristics. Paper of the type disclosed in U.S. Pat. No. 3,293,115, of Lucken, has been found to be particularly effective, although any machine sized paper with adequate solvent hold-out characteristics can be used. Coated papers, such as dielectric coated papers, can also be used if desired.

The following examples will serve further to illustrate the principles of the present invention. Each of these examples has been found to be equally applicable to the equipment configuration of each of the embodiments of this invention as hereinbefore described.

EXAMPLE 1

A positively charged electrostatic latent image was formed on the photoconductive surface of a recording member contained on the outer surface of a drum. The photoconductor used was photoconductive cadmium sulphide, charged and exposed in accordance with the teachings of U.S. Pat. No. 3,438,706.

The latent image bearing surface of the drum was then contacted with the surface of a sheet of copy paper of the type disclosed in U.S. Pat. No. 3,293,115, and plastic flow toner was introduced as hereinbefore described in relation to the first embodiment of this invention. The drum was rotated at a peripheral speed of 5"/second. The applied shear force was provided by application of a contact pressure of 8 oz/inch of drum width.

The plastic flow toner used was of the following compositions:

| | |
|---|---|
| Carbon black pigment | 15 grms |
| Low viscosity ethyl hydroxy-ethyl cellulose (bond forming or flocculating substance) | 80 grms |
| 6% Zirconium octoate | 5 grms |
| Isopar G | 400 grms |

Isopar G is an isoparaffinic hydrocarbon boiling range 320°–350° F., flash point 104° F. Kauri-Butanol value 27, manufactured by Exxon Corp., U.S.A. The image produced on the copy sheet was a facsimile reproduction of the original.

EXAMPLE 2

Example 1 was repeated, but the copy sheet was replaced with a sheet of bond paper coated on the side on which the image was developed with a 3 gsm layer of polyvinyl butyral resin.

EXAMPLES 3 and 4

Examples 1 and 2 were repeated using the configuration of the second embodiment of this invention as hereinbefore described.

EXAMPLES 5 and 6

Examples 1 and 2 were repeated using the configuration of the third embodiment of this invention as hereinbefore described.

EXAMPLES 7–12

Examples 1–6 were repeated, but using a plastic flow toner of negative polarity to produce a copy on the copy sheet which was a reversal of the original.

The negative toner was of the following composition:

| | |
|---|---|
| Carbon black pigment | 10 grms |
| Pentaerythritol dimeric resin acids ester | 5 grms |
| Paraffin wax | 10 grms |
| Hydrogenated castor oil (Bond forming or flocculating substance) | 10 grms |
| Alsol 1824 | 400 grms |

Alsol 1824 is an aliphatic hydrocarbon, boiling range 362°–460° F., flash point 140° F., Kauri-Butanol value 31, manufactured by Esso Aust. Ltd.

There has been described a method of and means for producing facsimile or reverse copy of original matter on substantially plain paper sheets using novel toner compositions in a manner not heretofore possible. It will be realised that the examples given are illustrative only, and that the type of dielectric or photoconductive material for electrostatic latent image formation, toner formulations, developing speeds, developing pressures, and paper stock used may be varied as desired by those skilled in the art without departing from the principles of the invention herein described.

We claim:

1. The method for pressure induced development of electrostatic latent images comprising the steps of:

forming an electrostatic latent image on the surface of a drum, forming a contact area between said latent image bearing drum and a pressure roller, inserting a copy receiving sheet into said contact area in face contact with said latent image bearing surface of said drum on which an electrostatic latent image has been formed, applying to one of said surfaces being in face contact a dispersion in a first state wherein the flow properties of said dispersion are non-Newtonian and wherein said dispersion consists of liquid phase and of a solid phase comprising electroscopic marking particles and a resinous floculating bonding medium therefore to establish a matrix sufficiently strong to prevent extraction of individual electroscopic marking particles from said matrix by attraction to said electrostatic latent image, rotating said pressure roller to cause movement of said latent image bearing drum and of said copy receiving sheet through said contact area whilst advancing said dispersion in said first state between said contacting surfaces to said contact area, continuing rotating said pressure roller to advance at least a portion of said dispersion in said first state into said contact area, in said contact area applying to said dispersion a shear stress of sufficient magnitude to convert said dispersion from said first state to a second state wherein the flow properties of said dispersion become Newtonian and wherein said solid phase is deflocculated in said liquid phase, to effect pressure induced development of the electrostatic latent image which has been formed on said latent image bearing drum, and simultaneously to obtain a developed image on the copy receiving sheet, and separating said contacting surfaces after their passage through said contact area to produce an image deposit on each of said latent image bearing drum and copy receiving sheet.

2. A method for pressure induced development of electrostatic latent images as disclosed in claim 1, wherein said dispersion in said first state is applied to said copy receiving sheet.

3. A method for pressure induced development of electrostatic latent images as disclosed in claim 1, wherein said dispersion in said first state is applied to said latent image bearing drum.

4. A method for pressure induced development of electrostatic latent images as disclosed in claim 1 wherein said dispersion in said first state is applied to said latent image bearing drum at a surface area preceding the actual image bearing surface area.

5. A method for pressure induced development of electrostatic latent images as disclosed in claim 1, wherein said dispersion in said first state is applied simultaneously to both said latent image bearing drum and copy receiving sheet.

6. A method for pressure induced development of electrostatic latent images as disclosed in claim 1 wherein said electroscopic marking particles deposited on said copy receiving sheet are of such polarity that the image deposit formed on said copy receiving sheet is a facsimile reproduction of said electrostatic latent image contained on said drum.

7. A method for pressure induced development of electrostatic latent images as disclosed in claim 1 wherein said electroscopic marking particles deposited on said copy receiving sheet are of such polarity that the image deposit formed on said copy receiving sheet is reverse reproduction of said electrostatic latent image contained on said drum.

8. The method for pressure induced development of electrostatic latent images comprising the steps of:

forming an electrostatic latent image on a drum;

forming a contact area between said latent image bearing drum and a movable member for pressing said latent image bearing drum;

inserting an unsensitized sheet into said contact area in face contact with said latent image bearing surface of said drum on which an electrostatic latent image has been formed, said unsensitized sheet being coated on the side on which the image is developed with a layer of resin;

applying to one of said surfaces being in face contact a dispersion in a first state wherein the flow properties of said dispersion are non-Newtonian and wherein said dispersion consists of liquid phase having a dielectric constant less than 3 and volume resistivity in excess of $10^9$ ohm cm, and of a solid phase comprising electroscopic marking particles and a resinous floculating bonding medium therefore to establish a matrix sufficiently strong to prevent extraction of individual electroscopic marking particles from said matrix by attraction to said electrostatic latent image;

moving said movable pressure member to cause movement of said latent image bearing drum and of said unsensitized sheet through said contact area whilst advancing said dispersion in said first state between said contacting surfaces to said contact area;

continuing moving said pressure member to advance at least a portion of said dispersion in said first state into said contact area;

in said contact area applying to said dispersion a shear stress of sufficient magnitude to convert said dispersion from said first state to a second state wherein the flow properties of said dispersion become Newtonian and wherein said solid phase is defloculated in said liquid phase, to effect pressure induced development of the electrostatic latent image which has been formed on said latent image bearing drum, and simultaneously to obtain a developed image on said coated surface of the unsensitized sheet; and separating said contacting surfaces after their passage through said contact area to produce an image deposit on each of said latent image bearing drum and coated side of the unsensitized sheet.

9. A method for pressure induced development of electrostatic latent images as disclosed in claim 8, wherein said dispersion in said first state is applied to said copy receiving sheet.

10. A method for pressure induced development of electrostatic latent images as disclosed in claim 8, wherein said dispersion in said first state is applied to said latent said disperson in said first state is applied to said latent image bearing drum.

11. A method for pressure induced development of electrostatic latent images as disclosed in claim 8, wherein said dispersion in said first state is applied to said latent image bearing drum at a surface area preceding the actual image bearing surface area.

12. A method for pressure induced development of electrostatic latent images as disclosed in claim 8, wherein said dispersion in said first state is applied simultaneously to both said latent image bearing drum and copy receiving sheet.

13. A method for pressure induced development of electrostatic latent images as disclosed in claim 8, wherein said electroscopic marking particles deposited on said copy receiving sheet are of such polarity that the image deposit formed on said copy receiving sheet is a facsimile reproduction of said electrostatic latent image contained on said drum.

14. A method for pressure induced development of electrostatic latent images as disclosed in claim 8, wherein said electroscopic marking particles deposited on said copy receiving sheet are of such polarity that the image deposit formed on said copy receiving sheet is reverse reproduction of said electrostatic latent image contained on said drum.

15. In an electrophotographic imaging method of the type including forming an electrostatic latent image on a drum surface, applying to said drum surface a dispersion in a first state wherein the flow properties of the dispersion are non-Newtonian and wherein said dispersion consists of a liquid phase having a dielectric constant less than 3 and volume resistivity in excess of $10^9$ ohm cm, and of a solid phase comprising electroscopic marking particles and a resinous floculating bonding medium therefore to establish a matrix sufficiently strong to prevent extraction of individual electroscopic marking particles from said matrix by attraction to said electrostatic latent image, and applying to said dispersion a shear stress of sufficient magnitude to convert said dispersion from said first state to a second state wherein the flow properties of said dispersion become Newtonian and wherein said solid phase is defloculated in said liquid phase whereby individual electroscopic marking particles are attracted to said electrostatic latent image contained on said surface and deposited thereon, the improvement comprising:

inserting an image transferring unsensitized sheet into an area in which said shear stress is applied in a face to face relationship with said surface containing the electrostatic latent image, said image transferring unsensitized sheet being coated on the side on which the particle image deposits with a layer of resin thereby to facilitate simultaneous depositions of particle image on both of said surface containing electrostatic latent image and said surface of the image transferring unsensitized sheet.

16. In an electrophotographic imaging method of the type including; forming an electrostatic latent image on a drum surface, applying to said drum surface a dispersion in a first state wherein the flow properties of the dispersion are non-Newtonian and wherein said dispersion consists of a liquid phase having a dielectric constant less than 3 and volume resistivity in excess of $10^9$ ohm cm, and of a solid phase comprising electroscopic marking particles and resinous floculating bonding medium therefore to establish a matrix sufficiently strong to prevent extraction of individual electroscopic marking particles from said matrix by attraction to said electrostatic latent image, and applying to said dispersion a shear stress of sufficient magnitude to convert said dispersion from said first state to a second state wherein the flow properties of said dispersion become Newtonian and wherein said solid phase is defloculated in said liquid phase whereby individual electroscopic marking particles are attracted to said electrostatic latent image contained on said surface and deposited thereon, the improvement comprising:

inserting an image transferring unsensitized sheet into an area where said shear stress is applied in a face to face relationship with said surface containing the electrostatic latent image; and controlling the application of said dispersion to the surface in such a manner that a controlled quantity of said dispersion is applied for a pre-selected time so as to produce an image of particles simultaneously deposited on said latent image bearing surface and on said image transferring unsensitized sheet.

17. The method for pressure induced development of electrostatic latent image comprising the steps of:

forming an electrostatic latent image on a drum;

forming a contact area between said latent image bearing drum and a movable member for pressing said latent image bearing drum;

inserting an image receiving unsensitized sheet into said contact area in face contact with said latent image bearing surface of said drum on which an electrostatic latent image has been formed, said image receiving unsensitized sheet being coated on the side on which the image is developed with a layer of resin;

applying to one of said surfaces in face contact a dispersion in a first state wherein the flow properties of said dispersion are non-Newtonian and wherein said dispersion consists of liquid phase having a dielectric constant less than 3 and volume resistivity in excess of $10^9$ ohm cm, and of a solid phase comprising electroscopic marking particles and a resinous floculating bonding medium therefore to establish a matrix sufficiently strong to prevent extraction of individual electroscopic marking particles from said matrix by attraction to said electrostatic latent image;

controlling said application of the layer of particle dispersion in such a manner that a controlled quantity of said dispersion is applied for a pre-selected time;

moving said movable pressure member to cause movement of said latent image bearing drum and of said image receiving unsensitized sheet through said contact area whilst advancing said dispersion in said first state between said contacting surfaces to said contact area;

continuing moving said pressure member to advance at least a portion of said dispersion in said first state into said contact area;

in said contact area applying to said dispersion a shear stress of sufficient magnitude to convert said dispersion from said first state to a second state wherein the flow properties of said dispersion become Newtonian and wherein said solid phase is defloculated in said liquid phase, to effect pressure induced development of the electrostatic latent image which has been formed on said latent image bearing drum, and simultaneously to obtain a developed image on said coated surface of the image receiving unsensitized sheet; and separating said contacting surfaces after their passage through said contact area to produce an image deposit on each of said latent image bearing drum and coated side of the image receiving unsensitized sheet.

* * * * *

UNITED STATES PATENT AND TRADEMARK OFFICE

CERTIFICATE OF CORRECTION

PATENT NO. : 4,152,151

DATED : May 1, 1979

INVENTOR(S) : TERENCE M. LAWSON ET AL

It is certified that error appears in the above-identified patent and that said Letters Patent are hereby corrected as shown below:

On Title page, "[73] Assignee:" change "Research Laboratories of Australia..." to read --Canon Kabushiki Kaisha, Tokyo, Japan--.

Col. 2, line 13, change "on" to --or--.

Col. 6, line 56, change "charges" to --charged--.

Col. 12, line 4, delete "said latent said disperson in said first state is applied to".

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*